US009772637B2

(12) United States Patent
Kuan et al.

(10) Patent No.: US 9,772,637 B2
(45) Date of Patent: Sep. 26, 2017

(54) VOLTAGE REGULATION CIRCUITS AND POWER SUPPLY DEVICES USING THE SAME

(71) Applicant: MediaTek Inc., Hsin-Chu (TW)

(72) Inventors: Chien-Wei Kuan, Hsinchu (TW); Jyh-Pyng Lay, Taichung (TW); Chih-Ching Yu, Hsinchu (TW); Yuh-Long Yeh, Taipei (TW)

(73) Assignee: MediaTek Inc., Hsin-Chu (TW)

( * ) Notice: Subject to any disclaimer, the term of this patent is extended or adjusted under 35 U.S.C. 154(b) by 405 days.

(21) Appl. No.: 13/912,821

(22) Filed: Jun. 7, 2013

(65) Prior Publication Data

US 2014/0361760 A1 Dec. 11, 2014

(51) Int. Cl.
*G05F 1/46* (2006.01)

(52) U.S. Cl.
CPC ..... *G05F 1/46* (2013.01)

(58) Field of Classification Search
CPC ..... G05F 1/46
USPC ..... 363/21.12–21.18; 320/104
See application file for complete search history.

(56) References Cited

U.S. PATENT DOCUMENTS

| | | | | |
|---|---|---|---|---|
| 4,658,198 | A * | 4/1987 | Thurber, Jr. | G01R 19/16576 323/274 |
| 5,710,506 | A * | 1/1998 | Broell et al. | 320/145 |
| 7,956,494 | B2 | 6/2011 | Amerom et al. | |
| 8,040,116 | B2 | 10/2011 | Xia et al. | |
| 8,866,341 | B2 | 10/2014 | Riederer | |
| 2009/0141520 | A1* | 6/2009 | Grande et al. | 363/21.16 |
| 2010/0244804 | A1 | 9/2010 | Zong et al. | |
| 2012/0249083 | A1* | 10/2012 | Garrastacho et al. | 320/155 |

FOREIGN PATENT DOCUMENTS

CN 101714778 A 5/2010

* cited by examiner

*Primary Examiner* — Jue Zhang
(74) *Attorney, Agent, or Firm* — Wolf, Greenfield & Sacks, P.C.

(57) ABSTRACT

A voltage regulation circuit is provided. The voltage regulation circuit regulates a level of a supply voltage provided by an automotive battery. The voltage regulation circuit includes a selector and an error amplifier. The selector receives a plurality of predetermined voltages and selects one of the plurality of predetermined voltages according to a control signal to serve as a first reference voltage. The error amplifier generates an error signal according to the first reference voltage and a feedback signal. The feedback signal is related to the supply voltage. The voltage regulation circuit regulates the level of the supply voltage according to the error signal.

19 Claims, 2 Drawing Sheets

VOLTAGE REGULATION CIRCUITS AND POWER SUPPLY DEVICES USING THE SAME

BACKGROUND OF THE INVENTION

Field of the Invention

The invention relates to a voltage regulation circuit, and more particularly to a voltage regulation circuit for regulating a supply voltage provided by an automotive battery of an automobile.

Description of the Related Art

In a conventional power supply device of an automobile, a supply voltage provided by an automotive battery is regulated by a regulation circuit in response to the operation state of the automobile. A feedback voltage related to the supply voltage is provided to a set of voltage division resistors for a regulation operation of the supply voltage. The set of voltage division is disposed outside of the chip of the regulation circuit. By changing or programming the resistance ratio of the voltage division resistors, the level of the supply voltage can be regulated. In the conventional power supply device, a chip requires additional pins to charge or program a resistance ratio. Moreover, it is necessary to ensure switches which are used to change or program the resistance ratio large enough for the high accuracy of the resistance ratio. The large switch implies large area, and large production cost as well.

BRIEF SUMMARY OF THE INVENTION

Thus, it is desirable to provide a voltage regulation circuit for an automotive battery, which has a reduced number of chip pins and reduced external circuits, and may not necessarily change or program a resistance ratio of a set of voltage division resistors.

An exemplary embodiment of a voltage regulation circuit is provided. The voltage regulation circuit regulates a level of a supply voltage provided by an automotive battery. The voltage regulation circuit comprises a selector and an error amplifier. The selector receives a plurality of predetermined voltages and selects one of the plurality of predetermined voltages according to a control signal to serve as a first reference voltage. The error amplifier generates an error signal according to the first reference voltage and a feedback signal. The feedback signal is related to the supply voltage. The voltage regulation circuit regulates the level of the supply voltage according to the error signal.

An exemplary embodiment of a power supply device for an automobile is provided. The power supply device comprises an automotive battery and a voltage regulation circuit. The automotive battery provides a supply voltage to the automobile. The voltage regulation circuit regulates a level of the supply voltage. The voltage regulation circuit comprises a selector and an error amplifier. The selector receives a plurality of predetermined voltages and selects one of the plurality of predetermined voltages according to a control signal to serve as a first reference voltage. The error amplifier generates an error signal according to the first reference voltage and a feedback signal. The feedback signal is related to the supply voltage. The voltage regulation circuit regulates the level of the supply voltage according to the error signal.

Another exemplary embodiment of a voltage regulation circuit is provided. The voltage regulation circuit regulates a level of a supply voltage provided by an automotive battery. The voltage regulation circuit comprises an error amplifier and a driver. The error amplifier generates an error signal according to a first reference voltage and a feedback signal. The first reference voltage is at a first voltage level during a first regulation period and at a second voltage level during a second regulation period. The driver regulates the level of the supply voltage according to the error signal. The feedback signal is related to the supply voltage.

Another exemplary embodiment of a power supply device for an automobile is provided. The power supply device comprises an automotive battery and a voltage regulation circuit. The automotive battery provides a supply voltage to the automobile. The voltage regulation circuit regulates a level of the supply voltage. The voltage regulation circuit comprises an error amplifier and a driver. The error amplifier generates an error signal according to a first reference voltage and a feedback signal. The first reference voltage is at a first voltage level during a first regulation period and at a second voltage level during a second regulation period. The driver regulates the level of the supply voltage according to the error signal. The feedback signal is related to the supply voltage.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
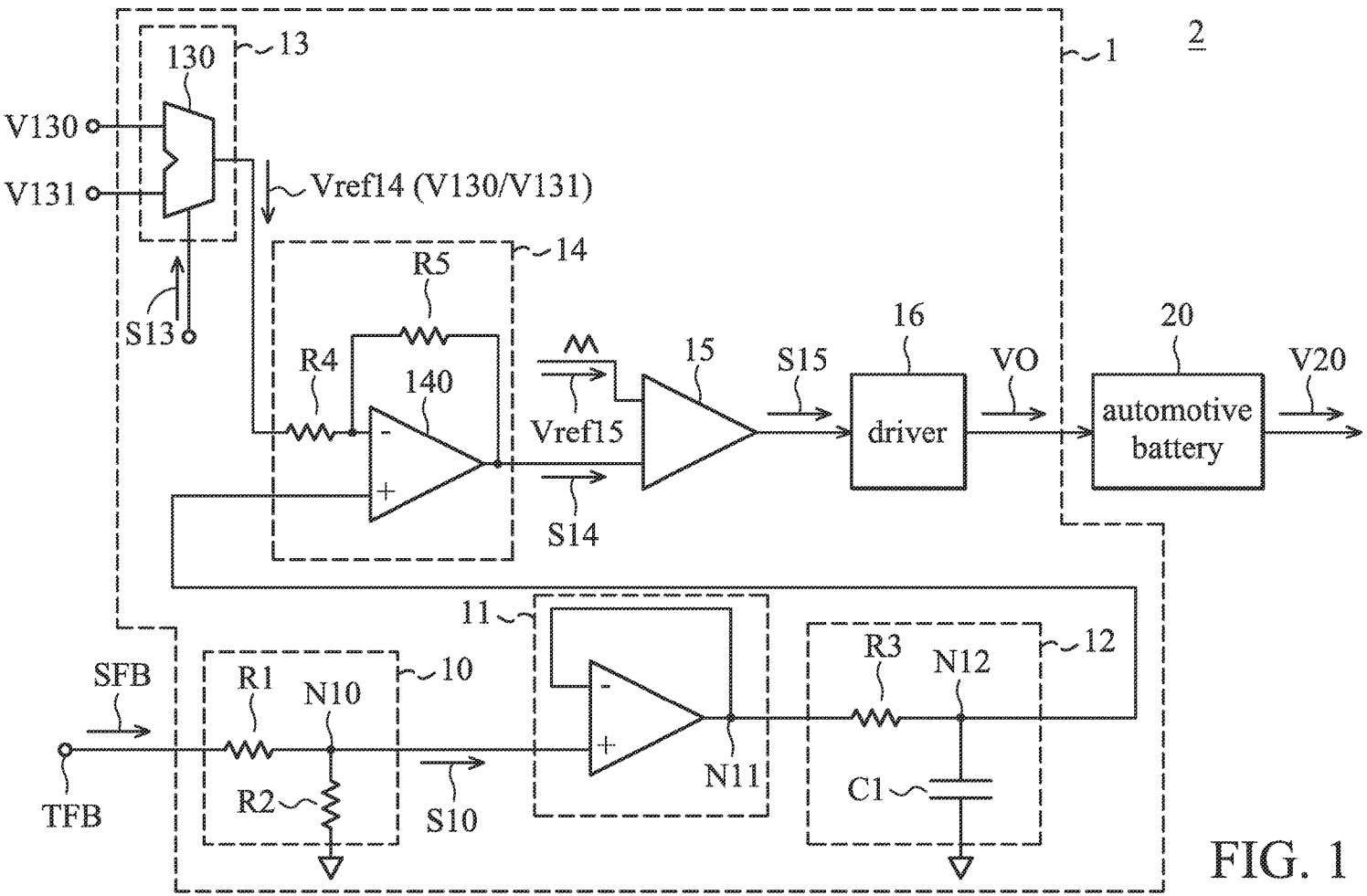
FIG. 1 shows an exemplary embodiment of a voltage regulation circuit.

Voltage regulation circuits and power supply devices are provided. In an exemplary embodiment of a voltage regulation circuit in FIG. 1, a voltage regulation circuit 1 is applied to control an automotive battery 20 of an automobile. In the embodiment, the voltage regulation circuit 1 and the automotive battery 20 form a voltage supply device 2. Referring to FIG. 1, the voltage regulation circuit 1 comprises a voltage divider 10, a buffer 11, a low pass filter 12, a selector 13, an error amplifier 14, a comparator 15, and a driver 16. The voltage divider 10 comprises resistors R1 and R2 which are coupled in series between a feedback terminal TFB and a reference ground GND. The voltage divider 10 receives a feedback signal SFB through the feedback terminal TFB and performs a voltage division operation to the feedback signal SFB to generate a divided voltage signal S10 at the joint node N10 between the resistors R1 and R2. The voltage level of the divided voltage signal S10 is determined according to the resistance ratio of the resistors R1 and R2 and the voltage level of the feedback signal SFB. The voltage level of the feedback signal SFB is related to a supply voltage V20 provided by the automotive battery 20. In the embodiment, for system design simplicity, the resistance ratio of the resistors R1 and R2 is fixed. In other words, each of the resistors R1 and R2 has a fixed resistance value. However, this is not meant to be a limitation of the present invention.

The buffer 11 is coupled to the voltage divider 10 at the joint node N10, and, thus, the divided voltage signal S10 is provided to the positive input terminal of the buffer 11. The buffer 11 buffers the divided voltage signal S10 to a node N11. The low pass filter 12 is coupled to the buffer 11 at the node N11. As shown in FIG. 1, in the embodiment, the low pass filter 12 comprises a resistor R3 and a capacitor C1 which are coupled in series between the node N11 and the reference ground GND. The joint node N12 between the resistor R3 and the capacitor C1 is coupled to the error amplifier 14. The low pass filter 12 receives the divided voltage signal S10 buffered by the buffer 11 and filters the high-frequency components of the divided voltage signal S10. Then, the divided voltage signal S10 filtered by the low pass filter 12 is provided to the error amplifier 14.

Referring to FIG. 1, the selector 13 receives a plurality of predetermined voltages. In the embodiment of FIG. 1, two predetermined voltages V130 and V131 are given as an example. The selector 13 selects one of the two predetermined voltage V130 and V131 to serve as a reference voltage for the error amplifier 14. In the embodiment, the selector 13 is implemented by a multiplexer 130 with two input terminals, one output terminal, and one control terminal. The two input terminals of the multiplexer 130 receive the predetermined voltages V130 and V131, respectively, and the output terminal thereof generates a reference voltage Vref14 for the error amplifier 14. The multiplexer 130 receives a control signal S13 through the control terminal and selects one of the two predetermined voltage V130 and V131 according to the control signal S13 to serve as the reference voltage Vref14 of the error amplifier 14.

The error amplifier 14 comprises an operational amplifier 140 and two resistors R4 and R5. The resistor R4 is coupled between the output terminal of the multiplexer 130 and the negative input terminal of the operational amplifier 140. The resistor R5 is coupled between the negative input terminal and the output terminal of the operational amplifier 140. The positive input terminal of the operational amplifier 140 receives the divided voltage signal S10 from the low pass filter 12. According to the operations of the operational amplifier 140 and the resistors R4 and R5, the error amplifier 14 generates an error signal S14 according to the difference between the level of the reference voltage Vref14 (e.g., the predetermined voltage V130 or V131) and the voltage level of the divided voltage signal S10 from the low pass filter 12. In other words, the error signal S14 can represent whether a difference between the reference voltage Vref14 and the divided voltage signal S10 has occurred. The comparator 15 receives the error signal S14 and a reference voltage Verf15 and compares the voltage level of the error signal S14 with the level of the reference voltage Vref15 to generate a driving signal S15. In the embodiment, the reference voltage Vref15 is represented by a saw wave signal. The driving signal S15 is a pulse width modulation (PWM) signal. The pulse width ratio of the driving signal S15 is varied with the variation of the comparison result of the comparator 15. When the error signal S14 represents that the difference between the reference voltage Vref14 and the divided voltage signal S10 has not occurred, the error signal S14 is at a stable level, and the driving signal S15 has a predetermined pulse width ratio, such as 50%. When the error signal S14 represents that the difference between the reference voltage Vref14 and the divided voltage signal S10 has occurred, the error signal S14 is not at the stable level, and the pulse width ratio of the driving signal S15 is shifted from the predetermined pulse width ratio to a larger or less pulse width, such as 40% or 60%. The driving signal S15 is used to control the automobile battery through the driver 16. In an embodiment, the driving signal S15 is received by the driver 16. The driver 16 generates an output voltage VO according to the driving signal S15. For example, the level of the output voltage VO is determined according to the pulse width ratio of the driving signal S15. The automotive battery 20 is then controlled by the output voltage VO, such as being charged by the output voltage VO, such that the automotive battery 20 can provide the supply voltage V20.

As the above described, the divided voltage signal S10 is derived from the feedback signal SFB, and the feedback signal SFB is related to the supply voltage V20 provided by the automotive battery 20. Thus, the voltage level of the divided voltage signal S10 can represent the level of the supply voltage V20. In the embodiment, in order to change the level of the output voltage VO for regulating the supply voltage V20, the value of the control signal S13 is changed, and the selector 13 selects one of the predetermined voltages V130 and V131 to serve as the reference voltage Vref14 according to the control signal S13 with the changed value. There is a difference between the level of the reference voltage Vref14 (the selected predetermined voltage) and the voltage level of the divided signal S10. According to the operation of the voltage regulation circuit 1, a close loop is formed through the supply voltage V20, the feedback signal VFB, and the output voltage VO, and the pulse width ratio of the driving signal S15 and the level of the output voltage VO in the close loop are changed. The supply voltage V20 provided by the automotive battery 20 is also changed with the change of the output voltage VO. When the voltage regulation circuit 1 is operating, the difference between level of the reference voltage Vref14 and the voltage level of the divided voltage signal S10 become less gradually. Accordingly, the supply voltage V20 is changed toward a predetermined level, and the voltage level of the divided voltage signal S10, which is derived from the supply voltage V20, moves to the level of the reference voltage Vref14. After the voltage regulation circuit 1 operates for a time period, the voltage level of the divided voltage signal S10 is equal to the level of the reference voltage Vref14, which means that the supply voltage V20 is regulated to the predetermined level. Accordingly, the regulation process of the supply voltage V20 is completed. When the value of the control signal S13 is changed again, another regulation process will start. According to the above described, the reference voltage Vref14 determined by the selector 13 is a target voltage, wherein the voltage level of the divided voltage signal S10 will be equal to the level of the reference voltage Vref14 when the supply voltage V20 reaches the predetermined level. At the same time, the output voltage VO is not changed any more, and the supply voltage V20 remains at the predetermined level. Thus, the supply voltage V20 is regulated with the charge of the reference voltage Vref14. In other words, the predetermined level of the supply voltage V20 is determined by the reference voltage Vref14. Although the reference voltage Vref14 of the error amplifier 14 is at a first voltage level (e.g. the predetermined voltages V130) during a first regulation period and at a second voltage level (e.g. the predetermined voltages V131) during a second regulation period, in other embodiments, the voltage regulation circuit 1 may have more than two regulation periods; for example, there may be three or more predetermined voltages provided to the selector 130, and the output voltage VO may be configured to three or more levels for different purposes.

In the embodiment, the buffer 11, the low pass filter 12, the selector 13, the error amplifier 14, the comparator 15, and the driver 16 are packaged in a chip. The voltage divider 10 is disposed outside of the chip. Since the reference voltage of the error amplifier 14 is programmable, the supply voltage of the automotive battery 20 can be regulated to several levels without the need of modifying the voltage divider 10. When the resistors R1 and R2 of the voltage divider 10 have fixed resistance values, the chip does not require pins to control the resistance values of the resistors R1 and R2, which can decrease the number of pins and external circuits (such as the large switches utilized by the conventional regulating circuits) of the chip. The voltage regulation circuit 1 also benefits by stable performance and simple circuit structure. The output voltage VO or the driving signal S15 has a quick response to the change of the reference voltage of the error amplifier 14.

Figure 2:
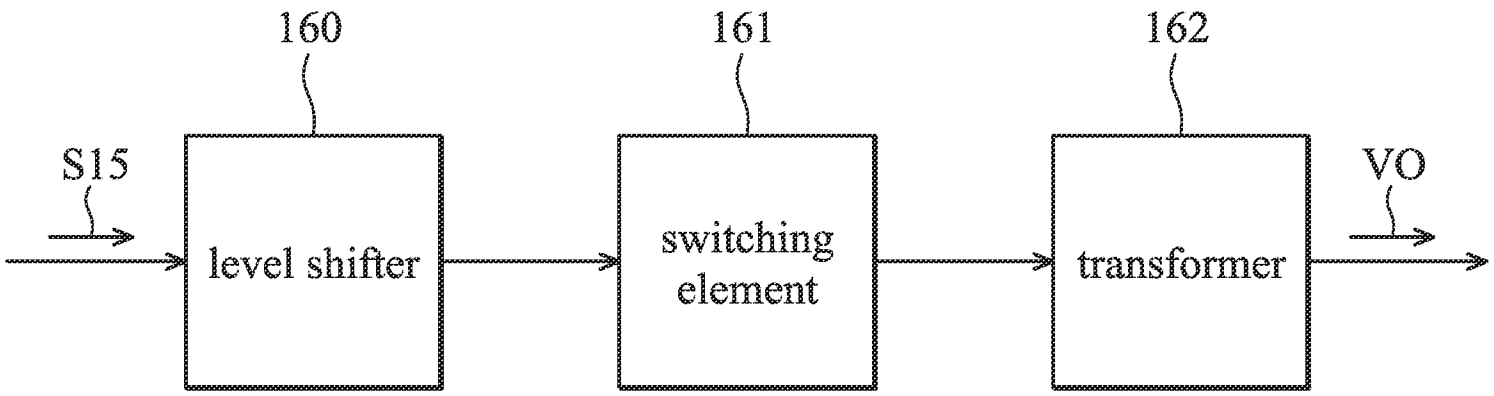
FIG. 2 shows an exemplary embodiment of a driver of the voltage regulation circuit in FIG. 1.

FIG. 2 shows the driver 16 of the voltage regulation circuit 1. Referring to FIG. 2, the driver 16 comprises a level shifter 160, a switching element 161, and a transformer 162. The level shifter 160 receives the driving signal S15 and changes the voltage level of the driving signal S15. In the embodiment, the level shifter 160 shifts the voltage level of the driving signal S15 to a voltage domain used by the switching element 161. The switching element 161, which is implemented by a power MOSFET in this embodiment, receives the driving signal at the power MOSFET domain, and controls the transformer 162 accordingly to switch the transformer 162, such that the transformer 162 generates the output voltage VO.

As the above described, the feedback signal VFB is related to the supply voltage V20 provided by the automotive battery 20. In an embodiment, the supply voltage V20 provided by the automotive battery 20 directly serves as the feedback signal. In another embodiment, the voltage level of the feedback signal VFB is proportional to the level of the supply voltage V20. In further another embodiment, there is a functional relationship between the voltage level of the feedback signal VFB and the level of the supply voltage V20.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A voltage regulation circuit for regulating a level of a supply voltage provided by an automotive battery, the voltage regulation circuit comprising:

a selector receiving a plurality of predetermined voltages and selecting one of the plurality of predetermined voltages according to a control signal to serve as a first reference voltage;

an error amplifier generating an error signal according to the first reference voltage and a divided voltage signal;

a voltage divider, receiving a feedback signal and performing a voltage division operation to the feedback signal to generate the divided voltage signal; and a buffer coupled between the voltage divider and the error amplifier and buffering the divided voltage signal to the error amplifier, wherein the buffer comprises a unity gain buffer amplifier, wherein the feedback signal is related to the supply voltage, wherein the plurality of predetermined voltages comprises at least a first predetermined voltage and a second predetermined voltage, and each of the first predetermined voltage and the second predetermined voltage is independent of the level of the supply voltage, wherein the voltage regulation circuit regulates the level of the supply voltage according to the error signal.

2. The voltage regulation circuit as claimed in claim 1, wherein the error amplifier generates the error signal according to a difference between a level of the first reference voltage and a voltage level of the divided voltage signal.

3. The voltage regulation circuit as claimed in claim 2, wherein the voltage divider comprises:

a first resistor and a second resistor which are coupled in series, wherein each of the first resistor and the second resistor has a fixed resistance value, and the divided voltage signal is generated at a joint node between the first resistor and the second resistor.

4. The voltage regulation circuit as claimed in claim 2, further comprising:

a low pass filter coupled between the voltage divider and the error amplifier and filtering high-frequency components of the divided voltage signal, wherein the divided voltage signal which is filtered by the low pass filter is transmitted to the error amplifier.

5. The voltage regulation circuit as claimed in claim 1, wherein the selector is implemented by a multiplexer.

6. The voltage regulation circuit as claimed in claim 1, further comprising:

a comparator receiving the error signal and comparing the error signal with a second reference voltage to generate a driving signal.

7. The voltage regulation circuit as claimed in claim 6, further comprising:

a driver receiving the driving signal and generating an output voltage according to the driving signal, wherein the level of the supply voltage is regulated according to the output voltage.

8. The voltage regulation circuit as claimed in claim 7, wherein the driver comprises:

a transformer generating the output voltage;

a switching element switching the transformer; and a level shifter receiving the driving signal and shifting a voltage level of the driving signal to a voltage domain utilized by the switching element for controlling the switching element.

9. A power supply device for an automobile comprising:

an automotive battery, providing a supply voltage; and a voltage regulation circuit regulating a level of the supply voltage, wherein the voltage regulation circuit comprises:

a selector, receiving a plurality of predetermined voltages and selecting one of the plurality of predetermined voltages according to a control signal to serve as a first reference voltage;

an error amplifier, generating an error signal according to the first reference voltage and a divided voltage signal;

a voltage divider, receiving a feedback signal and performing a voltage division operation to the feedback signal to generate the divided voltage signal; and a buffer coupled between the voltage divider and the error amplifier and buffering the divided voltage signal to the error amplifier, wherein the buffer comprises a unity gain buffer amplifier, wherein the feedback signal is related to the supply voltage, wherein the plurality of predetermined voltages comprises at least a first predetermined voltage and a second predetermined voltage, and each of the first predetermined voltage and the second predetermined voltage is independent of the level of the supply voltage, and wherein the voltage regulation circuit regulates the level of the supply voltage according to the error signal.

10. The voltage regulation circuit as claimed in claim 9, wherein the error amplifier generates the error signal according to a difference between a level of the first reference voltage and a voltage level of the divided voltage signal.

11. The power supply device as claimed in claim 10, wherein the voltage divider comprises:

a first resistor and a second resistor which are coupled in series, wherein each of the first resistor and the second resistor has a fixed resistance value, and the divided voltage signal is generated at a joint node between the first resistor and the second resistor.

12. The power supply device as claimed in claim 10, further comprising:

a low pass filter coupled between the voltage divider and the error amplifier and filtering high-frequency components of the divided voltage signal, wherein the divided voltage signal which is filtered by the low pass filter is transmitted to the error amplifier.

13. The power supply device as claimed in claim 9, wherein the selector is implemented by a multiplexer.

14. The power supply device as claimed in claim 9, further comprising:

a comparator receiving the error signal and comparing the error signal with a second reference voltage to generate a driving signal.

15. The power supply device as claimed in claim 14, further comprising:

a driver receiving the driving signal and generating an output voltage for regulating the level of the supply voltage according to the driving signal.

16. The power supply device as claimed in claim 15, wherein the driver comprises:

a transformer generating the output voltage;

a switching element switching the transformer; and a level shifter, receiving the driving signal and shifting a voltage level of the driving signal to a voltage domain utilized by the switching element for controlling the switching element.

17. A voltage regulation circuit for regulating a level of a supply voltage provided by an automotive battery, the voltage regulation circuit comprising:

an error amplifier generating an error signal according to a first reference voltage and a divided voltage signal that is generated based on a feedback signal, wherein the first reference voltage is at a first voltage level during a first regulation period and at a second voltage level during a second regulation period;

a comparator receiving the error signal and a second reference voltage; and a driver connected directly to the output of the comparator, the driver regulating the level of the supply voltage according to the error signal, wherein the driver comprises a level shifter, a switching element, and a transformer, and wherein the feedback signal is related to the supply voltage.

18. A power supply device for an automobile comprising: an automotive battery providing a supply voltage; and a voltage regulation circuit regulating a level of the supply voltage, wherein the voltage regulation circuit comprises:

an error amplifier generating an error signal according to a first reference voltage and a divided voltage signal that is generated based on a feedback signal, wherein the first reference voltage is at a first voltage level during a first regulation period and at a second voltage level during a second regulation period;

a comparator receiving the error signal and a second reference voltage; and a driver connected directly to the output of the comparator, the driver regulating the level of the supply voltage according to the error signal, wherein the driver comprises a level shifter, a switching element, and a transformer; wherein the feedback signal is related to the supply voltage.

19. A voltage regulation circuit for regulating a level of a supply voltage provided by an automotive battery, the voltage regulation circuit comprising:

a selector receiving a plurality of predetermined voltages and selecting one of the plurality of predetermined voltages according to a control signal to serve as a first reference voltage;

an error amplifier generating an error signal according to the first reference voltage and a divided voltage signal;

a voltage divider, receiving a feedback signal and performing a voltage division operation to the feedback signal to generate the divided voltage signal; and a buffer coupled between the voltage divider and the error amplifier and buffering the divided voltage signal to the error amplifier, wherein the buffer comprises a unity gain buffer amplifier having a negative input terminal directly connected to an output of the unity gain buffer amplifier, wherein the feedback signal is related to the supply voltage, wherein the plurality of predetermined voltages comprises at least a first predetermined voltage and a second predetermined voltage, and each of the first predetermined voltage and the second predetermined voltage is independent of the level of the supply voltage, wherein the voltage regulation circuit regulates the level of the supply voltage according to the error signal.

* * * * *